US006668930B2

(12) United States Patent
Hoffman

(10) Patent No.: US 6,668,930 B2
(45) Date of Patent: Dec. 30, 2003

(54) METHOD FOR INSTALLING AN EXPANDABLE COILED TUBING PATCH

(75) Inventor: Corey E. Hoffman, Magnolia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 35 days.

(21) Appl. No.: 10/106,178

(22) Filed: Mar. 26, 2002

(65) Prior Publication Data

US 2003/0183397 A1 Oct. 2, 2003

(51) Int. Cl.[7] ..... E21B 29/00

(52) U.S. Cl. ..... 166/298; 166/380; 166/297; 166/207; 166/55.8

(58) Field of Search ..... 166/298, 297, 166/55.8, 55.7, 55.6, 55, 208, 206, 207, 212, 380; 175/230; 72/370.07, 370.08; 83/54

(56) References Cited

U.S. PATENT DOCUMENTS

| | | | | |
|---|---|---|---|---|
| 761,518 A | | 5/1904 | Lykken | |
| 1,324,303 A | | 12/1919 | Carmichael | |
| 1,545,039 A | | 7/1925 | Deavers | |
| 1,561,418 A | | 11/1925 | Duda | |
| 1,569,729 A | | 1/1926 | Duda | |
| 1,597,212 A | | 8/1926 | Spengler | |
| 1,930,825 A | | 10/1933 | Raymond | 153/81 |
| 2,383,214 A | | 8/1945 | Prout | 153/82 |
| 2,499,630 A | | 3/1950 | Clark | 153/81 |
| 2,627,891 A | | 2/1953 | Clark | 153/82 |
| 2,663,073 A | | 12/1953 | Bieber et al. | 29/148 |
| 2,898,971 A | | 9/1959 | Hempel | 153/82 |
| 3,087,546 A | | 4/1963 | Wooley | 166/46 |
| 3,195,646 A | | 7/1965 | Brown | 166/208 |
| 3,467,180 A | | 9/1969 | Pensotti | 165/180 |
| 3,595,313 A | * | 7/1971 | Gray | 166/55.6 |
| 3,818,734 A | | 6/1974 | Bateman | 72/75 |
| 3,911,707 A | | 10/1975 | Minakov et al. | 72/76 |
| 4,069,573 A | | 1/1978 | Rogers, Jr. et al. | 29/421 R |
| 4,127,168 A | | 11/1978 | Hanson et al. | 166/123 |
| 4,159,564 A | | 7/1979 | Cooper, Jr. | 29/727 |

(List continued on next page.)

FOREIGN PATENT DOCUMENTS

| | | | |
|---|---|---|---|
| EP | 0 952 305 | 10/1999 | E21B/43/10 |
| EP | 0 961 007 A2 | 12/1999 | E21B/33/10 |
| GB | 1 457 843 | 12/1976 | B21D/39/10 |
| GB | 2 313 860 | 12/1997 | E21B/10/34 |
| GB | 2 320 734 A | 7/1998 | E21B/33/127 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |

OTHER PUBLICATIONS

U.S. patent application Ser. No. 09/470,176, Metcalfe et al., filed Dec. 22, 1999.

(List continued on next page.)

*Primary Examiner*—David Bagnell
*Assistant Examiner*—T. Shane Bomar
(74) *Attorney, Agent, or Firm*—Moser, Patterson & Sheridan, L.L.P.

(57) ABSTRACT

The present invention provides methods for expanding coiled tubing within a wellbore in order to form a patch. In one aspect, an expansion assembly is run into the wellbore at the lower end of a string of coiled tubing. The expansion assembly includes a cutting tool and an expander tool. The coiled tubing is run into the wellbore such that the expander tool is adjacent a portion of surrounding casing or other tubular body to be patched. The expander tool is actuated so as to expand a selected portion of the coiled tubing into frictional engagement with the surrounding casing, thereby forming a patch within the wellbore. The cutting tool is actuated so as to sever the coiled tubing downhole above the patch. The severed coiled tubing is then pulled, thereby removing the expansion assembly from the wellbore as well.

38 Claims, 11 Drawing Sheets

U.S. PATENT DOCUMENTS

| | | | | | |
|---|---|---|---|---|---|
| 4,288,082 | A | | 9/1981 | Setterberg, Jr. | 277/125 |
| 4,324,407 | A | | 4/1982 | Upham et al. | 277/27 |
| 4,429,620 | A | | 2/1984 | Burkhardt et al. | 91/395 |
| 4,502,308 | A | | 3/1985 | Kelly | 72/58 |
| 4,531,581 | A | | 7/1985 | Pringle et al. | 166/120 |
| 4,588,030 | A | | 5/1986 | Blizzard | 166/120 |
| 4,697,640 | A | | 10/1987 | Szarka | 166/120 |
| 4,848,469 | A | | 7/1989 | Baugh et al. | 166/382 |
| 5,271,472 | A | | 12/1993 | Leturno | 175/107 |
| 5,306,101 | A | * | 4/1994 | Rockower et al. | 405/184.3 |
| 5,322,127 | A | | 6/1994 | McNair et al. | 166/313 |
| 5,409,059 | A | | 4/1995 | McHardy | 166/208 |
| 5,435,400 | A | | 7/1995 | Smith | 175/61 |
| 5,472,057 | A | | 12/1995 | Winfree | 175/57 |
| 5,560,426 | A | | 10/1996 | Trahan et al. | 166/120 |
| 5,685,369 | A | | 11/1997 | Ellis et al. | 166/195 |
| 5,901,787 | A | | 5/1999 | Boyle | 166/135 |
| 6,021,850 | A | | 2/2000 | Wood et al. | 166/380 |
| 6,029,745 | A | * | 2/2000 | Broussard et al. | 166/298 |
| 6,098,717 | A | | 8/2000 | Bailey et al. | 166/382 |
| 6,142,230 | A | * | 11/2000 | Smalley et al. | 166/277 |
| 6,325,148 | B1 | | 12/2001 | Trahan et al. | 166/297 |
| 6,446,323 | B1 | * | 9/2002 | Metcalfe et al. | 29/523 |
| 6,457,532 | B1 | * | 10/2002 | Simpson | 166/380 |
| 6,543,552 | B1 | * | 4/2003 | Metcalfe et al. | 175/57 |
| 6,578,630 | B2 | * | 6/2003 | Simpson et al. | 166/55.8 |
| 2003/0106698 | A1 | * | 6/2003 | Simpson et al. | 166/382 |

OTHER PUBLICATIONS

U.S. patent application Ser. No. 09/469,690, Abercrombie, filed Dec. 22, 1999.

U.S. patent application Ser. No. 09/469,643, Metcalfe et al., filed Dec. 22, 1999.

U.S. patent application Ser. No. 09/469,526, Metcalfe et al., filed Dec. 22, 1999.

U.S. patent application Ser. No. 09/470,154, Metcalfe et al., filed Dec. 22, 1999.

U.S. patent application Ser. No. 09/469,681, Metcalfe et al., filed Dec. 22, 1999.

U.S. patent applicaion Ser. No. 09/462,654, Metcalfe, filed Dec. 19, 2000.

* cited by examiner

METHOD FOR INSTALLING AN EXPANDABLE COILED TUBING PATCH

BACKGROUND OF THE INVENTION

1. Field of the Invention

The present invention relates to oil and gas wellbore completion. More particularly, the invention relates to a system of completing a wellbore through the expansion of tubulars. More particularly still, the invention relates to methods for expanding a section of coiled tubing into a surrounding tubular so as to form a patch.

2. Description of the Related Art

In the drilling of oil and gas wells, a wellbore is formed using a drill bit that is urged downwardly at a lower end of a drill string. After drilling a predetermined depth, the drill string and bit are removed and a section of casing is lowered into the wellbore. An annular area is thus formed between the string of casing and the formation. The casing is temporarily hung from the surface of the well. A cementing operation is then conducted in order to fill the annular area with cement. Using apparatus known in the art, the casing is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed, or "hung" off of the existing casing by the use of slips which utilize slip members and cones to wedgingly fix the new string of liner in the wellbore. The second casing string is then cemented. This process is typically repeated with additional casing strings until the well has been drilled to total depth. In this manner, wells are typically formed with two or more strings of casing of an ever-decreasing diameter.

In many instances, the casing is perforated, typically at a lower region of the casing string. Alternatively, the last string of casing extending into the wellbore may be preslotted to receive and carry hydrocarbons through the wellbore towards the surface. In this instance, the hydrocarbons are filtered through a screened portion of tubular. In either instance, the hydrocarbons flow from the formation, into the wellbore, and then to the surface through a string of tubulars known as production tubing. Because the annulus between the casing and the production tubing is sealed with packers, the hydrocarbons flow into the production tubing en route to the surface.

Over the life of a well, circumstances may occur that change the properties of particular formations. For example, the pressure in a formation may fall, or a formation may begin to produce an unacceptably high volume of water. In these situations, it is known to run straddles into the well to patch the perforations adjacent the troubled formation. Straddles are sections of hard pipe with sealing arrangements at either end. Typically, the straddle is located downhole at the depth of the perforations. The seals are actuated into contact with the surrounding casing to isolate the perforations between the seals.

Additionally, there are varied other uses for a patch or straddle within a live well. For example, a straddle may be used to patch over corroded sections of tubulars within the wellbore, such as production tubing or casing. Straddles may also be used to patch over eroded sections of tubulars or to cover screens in gravel packs. Straddles may further be used to create a restricted flow area thereby increasing the velocity of a fluid during production of the well.

Conventional straddles tend to be complex in operation. A conventional straddle consists of a length of tubular having a mechanical packer at either end. The mechanical packers have moving parts that are expensive to fabricate and install. Conventional straddles require a source of hydraulic and/or mechanical force to actuate the seals. Further, conventional straddles of hard pipe result in a significant loss in bore cross section which chokes off the well, thereby reducing production capacity.

Another problem associated with existing straddles is the time and cost associated with locating and setting a straddle of hard pipe in a live well. Conventional straddles are run into a live well on a string of tubulars. Lowering a string of tubular into a live well requires the use of at least two pressure devices to safely maintain the well while running the tubular string. Such an operation also requires the placement of a large working unit for handling joints of working string. Removal of the string requires the same amount of time and energy.

There is a need, therefore, for an easier and less expensive system for patching or repairing a tubular. There is a further need for an improved assembly for patching or repairing a tubular in a live well. There is further a need for an apparatus and methods by which a section of tubular, such as casing or a sand screen, can be either straddled or patched by expanding a replacement section therein.

SUMMARY OF THE INVENTION

The present invention provides methods for expandably installing a section of coiled tubing in situ within a wellbore, including a live wellbore. The installed section of coiled tubing is used to form a patch within a surrounding tubular body. For purposes of the present inventions, the term "patch" includes any installation of a section of coiled tubing into a surrounding tubular body. Such patches include, but are not limited to: (1) the expansion of a section of coiled tubing along a desired length in order to seal perforations; (2) the expansion of coiled tubing above and below perforations in order to form a "straddle;" and (3) the expansion of a section of coiled tubing at a point above perforations in order to form a "velocity tube" and to isolate an upper portion of surrounding casing. The patch may also serve to support a corroded or weakened section of tubular. In any method of the present invention, the surrounding tubular body may comprise a string of production tubing, a string of casing, a sand screen, or any other tubular body disposed within a wellbore.

In the methods of the present invention, an assembly is run into the wellbore on a working string. The assembly in one aspect comprises a slip, a motor, a cutting tool, and an expander tool. In operation, the assembly is lowered into the wellbore on a string of coiled tubing. A section of coiled tubing to be expanded is located in the wellbore at the desired depth. The expander tool is then actuated, preferably through the use of hydraulic pressure, so as to expand the section of coiled tubing into a surrounding tubular. Thereafter, the coiled tubing is cut above the expanded region, thereby leaving a patch within the wellbore. The patch remains in the wellbore through frictional engagement with the surrounding tubular. The expansion assembly is then removed from the wellbore, along with the unexpanded portion of coiled tubing above the severance point.

In an alternate aspect of the invention, a method is provided which installs a patch into a wellbore as outlined above. Then, a new expansion assembly is run into the wellbore. The second expansion assembly is disposed within a working string, and is run into the wellbore adjacent the patch. The second expansion assembly in one aspect comprises a slip, a motor, a telescoping member, and rotating expander tool. The expander tool is actuated so as to expand additional lengths of the patch. At the same time, the telescoping member is actuated to translate the expander tool in order to extend the length of the patch within the wellbore. Alternatively, or in addition, the expander tool is translated by raising or lowering the working string from the surface.

In a further aspect, a method is provided which comprises providing coiled tubing which has been severed into an upper section and a lower section. An expansion assembly is then assembled which comprises a first slip, a second slip, a motor, a telescoping member, a cutting tool, a first expander tool, and a second expander tool. The first slip is activated to engage the upper section of coiled tubing. Similarly, the second slip is activated to engage the lower section of coiled tubing. The first and second slip of the expansion assembly are positioned together so that the upper and lower sections of coiled tubing are joined. In this manner, a continuous length of coiled tubing is essentially formed. The expansion assembly is run into the wellbore on the coiled tubing. The second expander tool is actuated to partially expand the lower section of tubing into frictional engagement with the surrounding casing in the wellbore. The second expander tool is de-activated, and the second slip is also then de-activated. The upper section of coiled tubing is then raised so as to align the first expander tool substantially with the upper end of the lower section of coiled tubing. The first expander tool is then actuated so as to begin expanding the lower section of tubing into the surrounding casing. At the same time, the expansion assembly is translated within the wellbore so as to form a patch of a desired length.

In one aspect, the first expander tool is configured to have pitched rollers. The pitched rollers cause the expansion assembly, including the first expander tool, to "walk" downward within the wellbore as the first expander tool is rotated. In another aspect, the first expander tool is further translated by actuating the telescoping member. After the patch has been fully formed, the upper section of coiled tubing is retrieved from the hole, thereby removing the expansion assembly as well.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
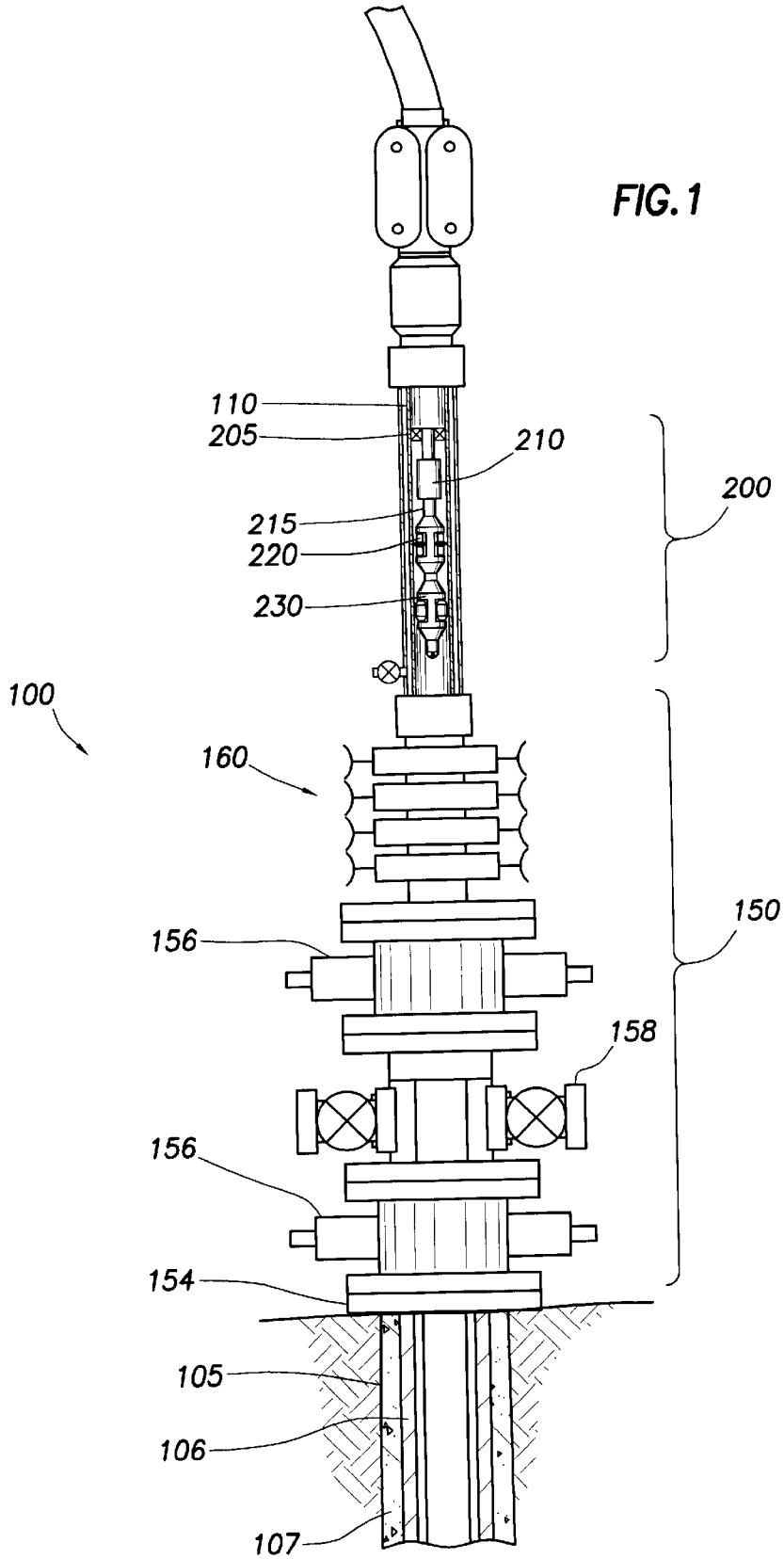
FIG. 1 is a schematic view of a wellhead. Visible above the wellhead is an assembly of the present invention for expanding a section of coiled tubing. The assembly is being run into a wellbore.

FIG. 1 is a schematic view of a wellhead 100. Visible above the wellhead 100 is an expansion assembly 200 of the present invention. As will be set forth in greater detail below, the expansion assembly 200 is designed to be hydraulically activated via pressurized fluid so as to expand a section of coiled tubing 110 into contact with a surrounding tubular body, such as a string of casing 106. In this respect, the outer surface of the coiled tubing 110 has a smaller outside diameter than the inner surface of the casing 106 prior to expansion.

The expansion assembly 200 is disposed within a string of coiled tubing 110 at a lower end thereof. The coiled tubing 110 is well known in the art and defines a continuous tubular product which is not only capable of carrying pressurized fluid, but is also flexible enough to be unrolled from a reel for convenient transportation and delivery into a wellbore 105. The expansion assembly 200 is preferably assembled at the surface. Thereafter, and as shown in FIG. 1, the assembly 200 is preferably run on the coiled tubing 110 through the wellhead 100 and into a wellbore 105.

The expansion assembly 200 shown in FIG. 1 is comprised of a series of components. The first component is a slip 205. The slip 205 is typically disposed at the top of the expansion assembly 200. The slip 205 is used to hang the remainder of the expansion assembly 200 within the coiled tubing 110. Preferably, the slip 205 defines an expandable tubular member which, when actuated, engages the inner surface of the surrounding string of coiled tubing 110. The outwardly actuated members typically define at least one outwardly extending serration or edged tooth (not shown) to provide a more secure frictional engagement with the inner surface of the coiled tubing 110. Optionally, the outwardly actuated members may land within a circumferential profile within the surrounding string of coiled tubing 110.

The slip 205 includes a hollow, threaded inner bore. The bore is internal to the slip 205, and permits fluid to flow from the coiled tubing 110 downward through the slip 205. From there, fluid flows to the other components of the expansion assembly 200.

Below the slip 205 is a motor 210. In one arrangement, a threaded, hollow make-up joint 215 connects the slip 205 to the motor 210, and places them in fluid communication with each other. Alternatively, the motor 210 is directly connected to the slip 205. The motor 210 may be any motor capable of providing rotation to the cutting tool 220 and the expander tool 225, which are both described below. For example, the motor 210 may be any electric or mud motor which are both well known in the art.

Disposed below the motor 210 is a cutting tool 220. An exploded view of a cutting tool 220 as might be used in the assembly 200 of the present invention is presented in FIG. 2. The cutting tool 220 primarily defines a central body 222 which is hollow and generally tubular. The cutting tool 220 includes connectors 224 and 226 disposed at the top and bottom ends of the central body 222. The connectors 224 and 226 are of a reduced diameter compared to the outside diameter of the central body 222, and are connectable to other components of the expansion assembly 200.

One or more expandable members 228 is disposed radially around the central body 222. In one arrangement, three expandable members 228 are circumferentially spaced apart around the central body 222 at 120 degree intervals. The expandable members 228 are more fully shown in the cross-sectional view of FIG. 3. FIG. 3 presents a cross-sectional view of the cutting tool of FIG. 2, taken across line 33. It can be seen that each expandable member 228 resides within a recess 227 in the central body 222. Each expandable member 228 defines a roller 221 connected to a slidable piston 223. The piston 223 is capable of sliding partially outwardly from its respective recess 227, thereby allowing the roller 221 to contact the inner surface of the coiled tubing 110 upon actuation.

The cutting tool 220 is designed to be actuated upon the injection of fluid under pressure into the coiled tubing 110. In operation, fluid flows through the tubular core 225 of the cutting tool 220, and contacts the backside of the piston 227 in each expandable member 228. Pressurized hydraulic pressure applied internal to the cutting tool 220 forces the rollers 221 radially outward to engage the surrounding coiled tubing 110. Each expandable member 228 includes a hard rib 229 which serves as a cutting instrument. The hard ribs 229 cause a compressive yield and a localized reduction in wall thickness of the coiled tubing 110 when extended, thereby severing the coiled tubing 110 at the point of engagement.

Figure 2:
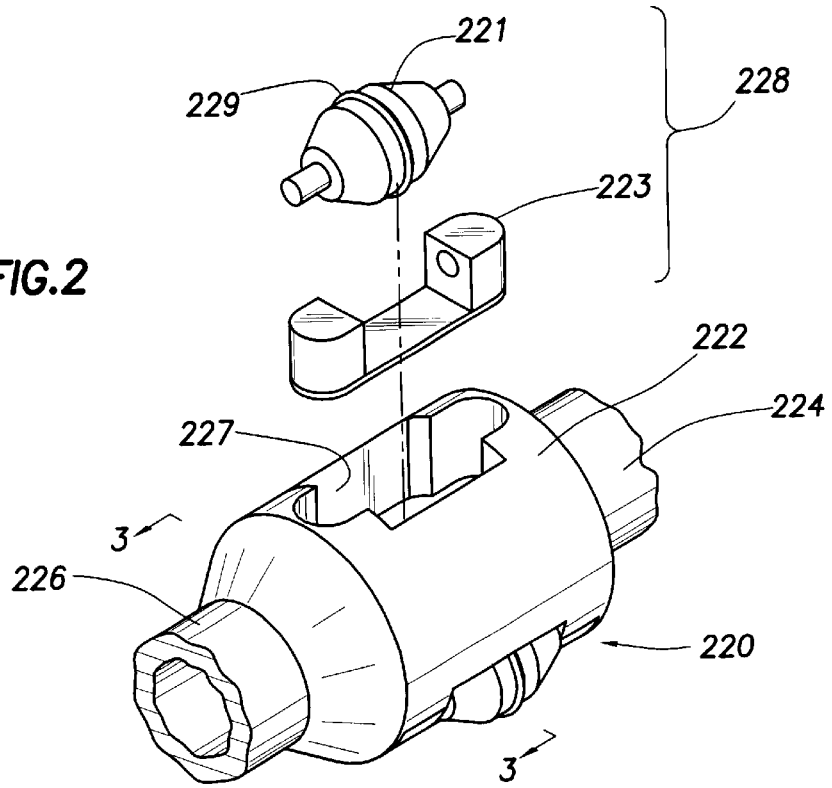
FIG. 2 is an exploded view of view of a cutting tool as might be used in the methods of the present invention.
Figure 3:
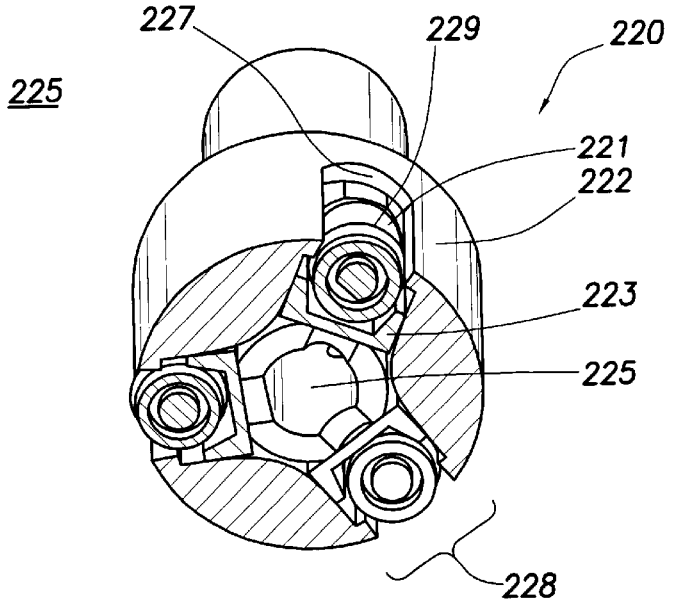
FIG. 3 is a cross-sectional view of the cutting tool of FIG. 3, taken across line 3—3.

The cutting tool 220 presented in FIGS. 2 and 3 are exemplary only. It is to be appreciated that other rotary cutting tools may be used. Further, as used herein, the term "sever" includes any means of disconnecting an expanded portion of coiled tubing from an unexpanded portion of coiled tubing. Thus, the present invention encompasses disconnecting an expanded coiled tubing portion from an unexpanded coiled tubing portion.

Figure 4:
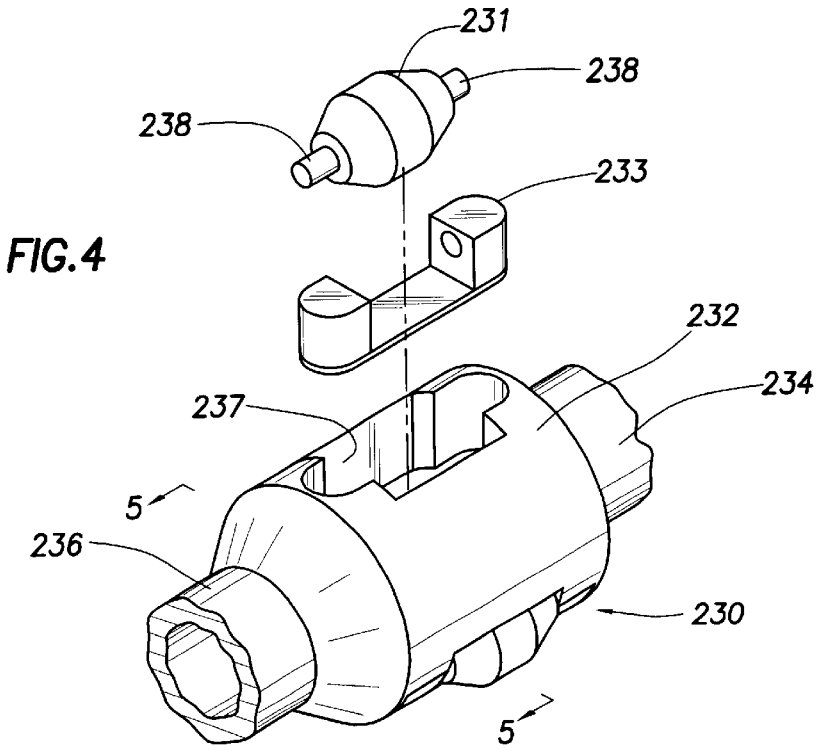
FIG. 4 is an exploded view of an expander tool as might be used in the methods of the present invention.
Figure 5:
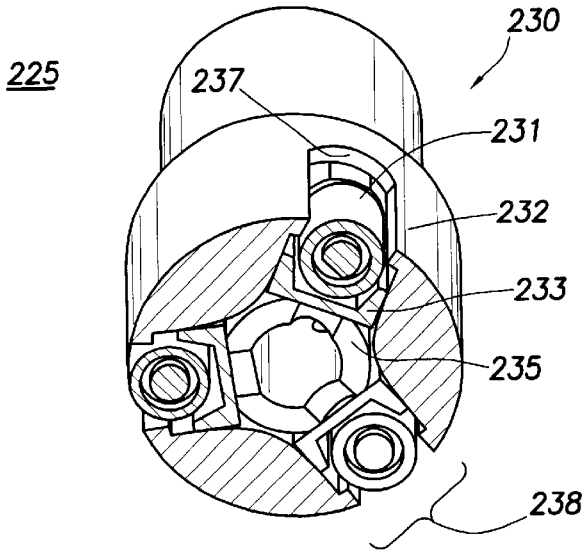
FIG. 5 is a cross-sectional view of the expander tool of FIG. 4, taken across line 5—5 of FIG. 4.

The expansion assembly 200 of the present invention also includes an expander tool 230. In the arrangement shown in FIG. 1, the expander tool 230 is positioned below the cutting tool 220. A larger exploded view of the expander tool 230 is shown in FIG. 4. FIG. 5 presents the same expander tool 230 in cross-section, with the view taken across line 5—5 of FIG. 4.

The expander tool 230 has a body 232 which is hollow and generally tubular. Connectors 234 and 236 are provided at opposite ends of the body 232 for connection to other components of the assembly 200. The connectors 234 and 236 are of a reduced diameter (compared to the outside diameter of the body 232 of the tool 230). The hollow body 232 allows the passage of fluids through the interior of the expander tool 230 and through the connectors 234 and 236.

As with the cutting tool 220, the expander tool 230 has three recesses 237 to hold a respective roller 231. Each of the recesses 237 has parallel sides and holds a roller 231 capable of extending radially from the radially perforated tubular core 235 of the tool 230.

In one embodiment of the expander tool 230, rollers 231 are near-cylindrical and slightly barreled. Each of the rollers 231 is supported by a shaft 238 at each end of the respective roller 231 for rotation about a respective rotational axis. The rollers 231 are generally parallel to the longitudinal axis of the tool 100. The plurality of rollers 231 are radially offset at mutual 120-degree circumferential separations around the central body 232. In the arrangement shown in FIG. 5, only a single row of rollers 231 is employed. However, additional rows may be incorporated into the body 232.

While the rollers 231 illustrated in FIG. 4 have generally cylindrical or barrel-shaped cross sections, it is to be appreciated that other roller shapes are possible. For example, a roller may have a cross sectional shape that is conical, truncated conical, semi-spherical, multifaceted, elliptical or any other cross sectional shape suited to the expansion operation to be conducted within the coiled tubing 110.

Each shaft 238 is formed integral to its corresponding roller 231 and is capable of rotating within a corresponding piston 233. The pistons 233 are radially slidable, one piston 233 being slidably sealed within each radially extended recess 237. The back side of each piston 233 is exposed to the pressure of fluid within the hollow core 235 of the tool 230 by way of the coiled tubing 110. In this manner, pressurized fluid provided from the surface of the well, via the coiled tubing 110, can actuate the pistons 233 and cause them to extend outwardly whereby the rollers 231 contact the inner surface of the coiled tubing 110 to be expanded.

The expander tool 230 is preferably designed for use at or near the end of a coiled tubing 110. In order to actuate the expander tool 230, fluid is injected into the coiled tubing 110 from the surface. Fluid under pressure then travels downhole through the coiled tubing 110 and into the perforated tubular core 235 of the tool 230. From there, fluid contacts the backs of the pistons 233. As hydraulic pressure is increased, fluid forces the pistons 233 from their respective recesses 237. This, in turn, causes the rollers 231 to make contact with the inner surface of the coiled tubing 110. Fluid finally exits the expander tool 230 through connector 236 at the base of the tool 230. The circulation of fluids to and within the expander tool 230 is regulated so that the contact between and the force applied to the inner wall of coiled tubing 110 is controlled. Control of the fluids provided to the pistons 233 ensures precise roller control capable of conducting the tubular expansion operations of the present invention that are described in greater detail below.

Figure 6:
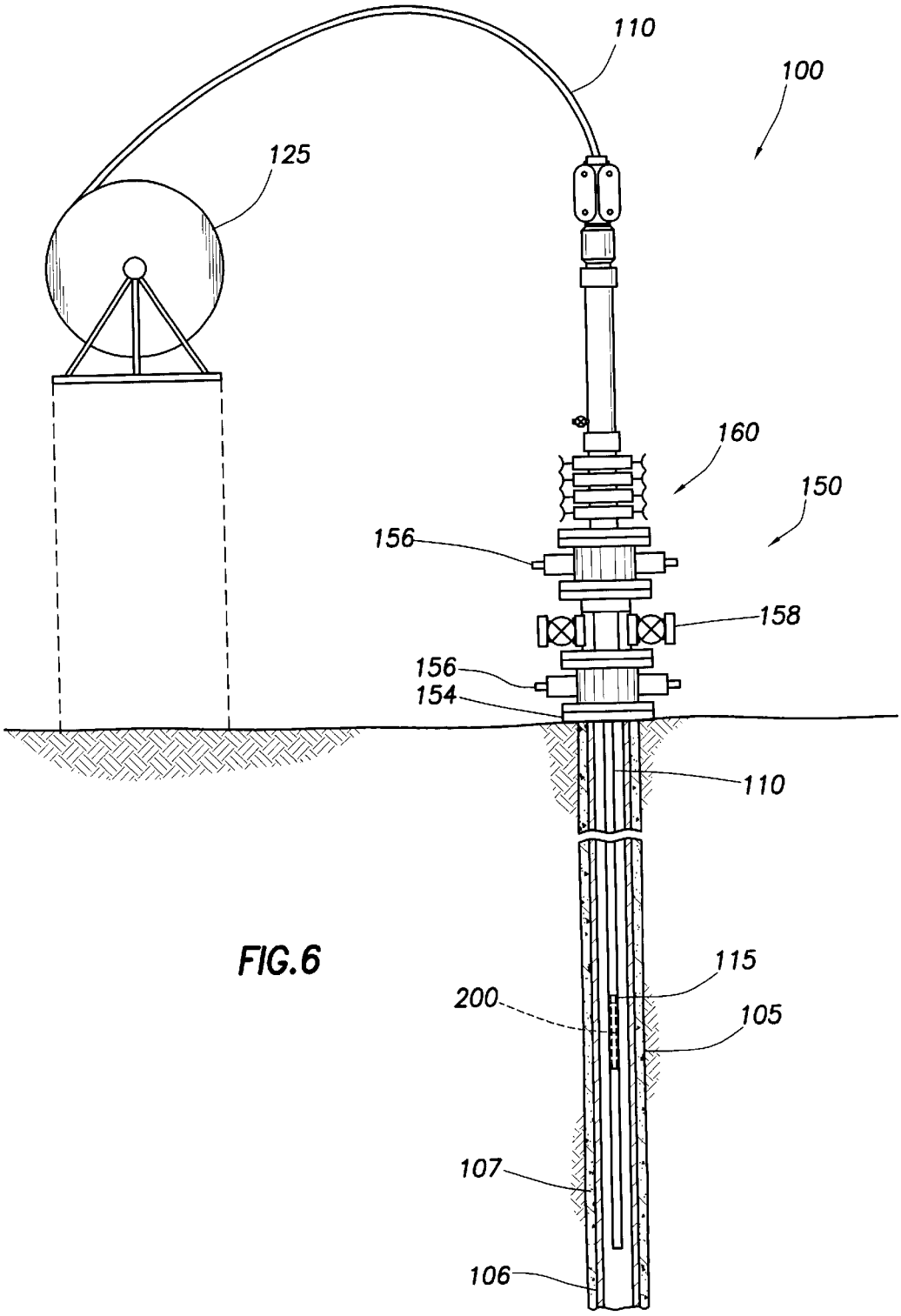
FIG. 6 is a schematic view of the wellhead of FIG. 1, showing a cross-sectional view of a wellbore receiving an assembly for expanding coiled tubing.

FIG. 6 presents a schematic view of the wellhead of FIG. 1. The wellhead 100 is again positioned over the wellbore 105. The wellhead components 105 typically include a casing head 154, one or more blowout preventers 156, a production tee 158, and a stuffing box 160. The stuffing box 160 serves to seal around the coiled tubing 110 as the coiled tubing 110 is lowered into the wellbore 105. In the view of FIG. 6, the wellbore 105 is receiving the coiled tubing 110 with the expansion assembly 200 therein. Visible in FIG. 6 is a reel 125 used to deliver the string of coiled tubing 110 into the wellhead 100. The coiled tubing 110 is delivered from the reel 125, and run into the wellbore 105 as one continuous tubular. An expandable section of coiled tubing is shown at 115.

As shown in FIG. 1 and FIG. 6, the wellbore 105 is typically lined with casing 106 that is permanently set with cement 107. The expansion assembly 200 and coiled tubing 110 therearound are lowered to a pre-determined depth adjacent a troubled perforation or corroded section of casing, for example for expanding a section of coiled tubing 110. Expansion of the coiled tubing 110 can then begin.

In one aspect of the present invention, a one-trip method is provided for expanding coiled tubing 110 into surrounding casing 106. Referring to FIGS. 7A–7D, an expansion assembly 700 is run into the wellbore 105 and positioned above or adjacent a group of perforations (not shown) or corroded casing (not shown) to be isolated. The expansion assembly 700 shown in FIG. 7A includes a slip 205, a motor 210, a cutting tool 220, and an expander tool 230 having rollers 231.

In operation, pressurized hydraulic pressure is supplied through the coiled tubing 110 and down to the expander tool 230. An initial application of elevated pressure causes the rollers 231 in the expander tool 230 to extend radially outward from the central body 232. The outward force of the rollers 231 causes the coiled tubing 231 to deform such that a point of frictional engagement is created between the outer surface of the coiled tubing 231 and the inner surface of the surrounding casing 106. The motor 210 is also actuated, causing the expander tool 230 to rotate within the coiled tubing 110. This provides for a radial expansion of the coiled tubing 110 against the casing 106.

Figure 7A:
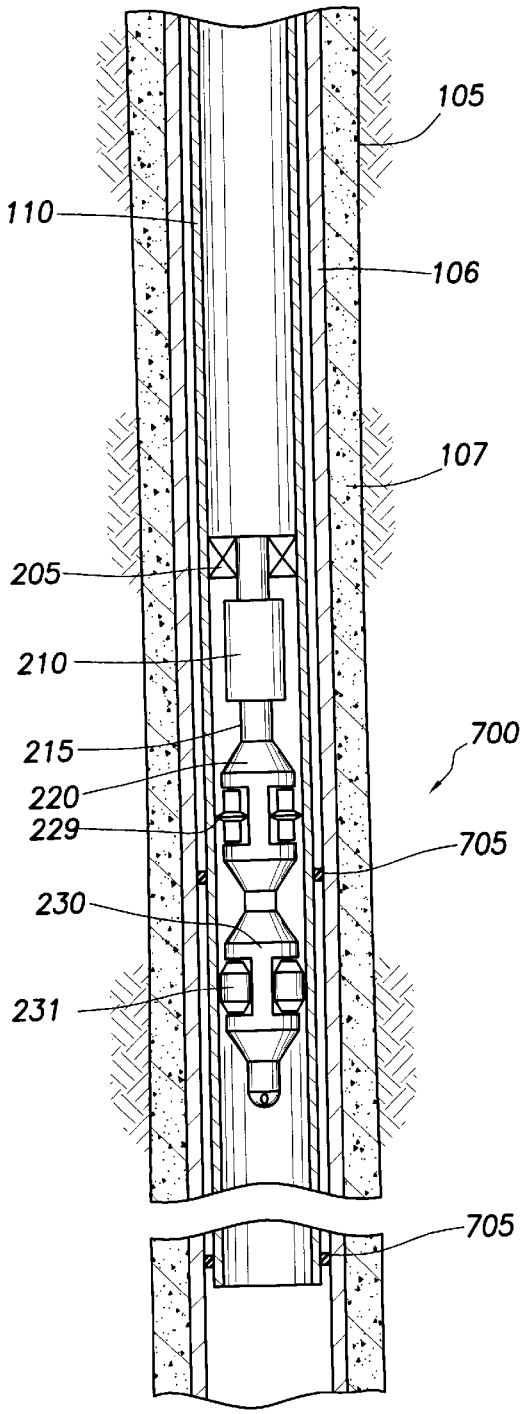
FIG. 7A is a sectional view of the wellbore of FIG. 6. In this view, an assembly for expanding coiled tubing has been run into the wellbore. Visible in this view is a string of coiled tubing, a section of which will be expanded into frictional engagement with the surrounding casing.
Figure 7B:
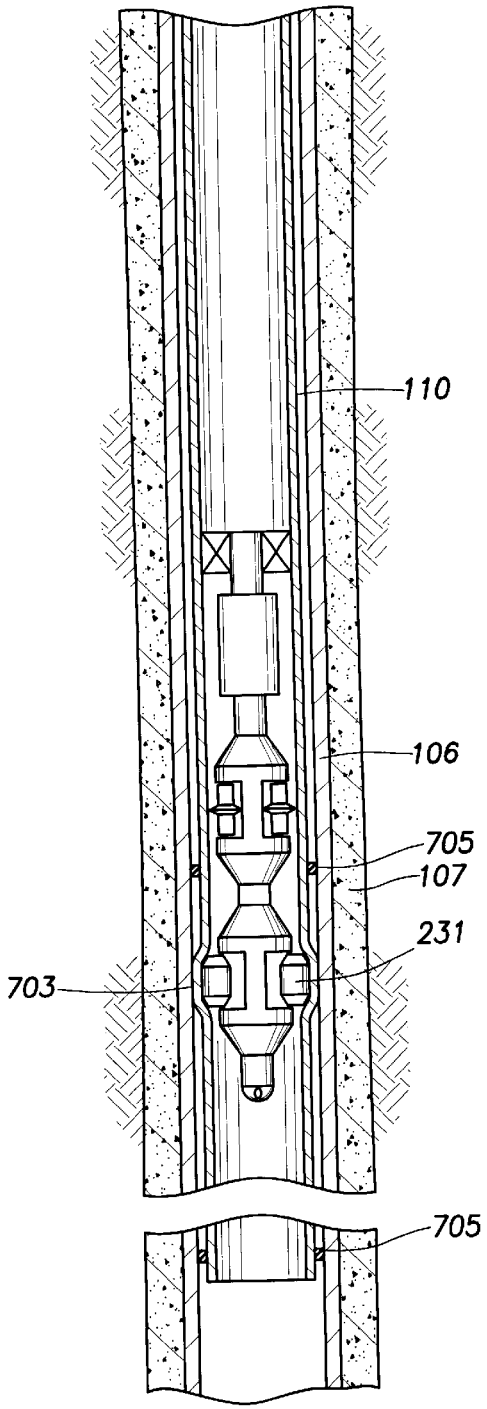
FIG. 7B is a sectional view of the wellbore of FIG. 7A, with the coiled tubing now being expanded into the surrounding casing. As can be seen, the expander tool has been actuated to accomplish expansion.

The initially expanded state of the coiled tubing 110 is depicted in FIG. 7B. FIG. 7B is a sectional view of the wellbore of FIG. 7A, with the coiled tubing 110 now being expanded into the surrounding casing 106. As can be seen, the expander tool 230 has been actuated to accomplish initial expansion. Deformation of the coiled tubing 110 creates a localized reduction in wall thickness, and a corresponding increase in wall diameter. The expansion process effectively removes the annular region between the coiled tubing 110 and the casing 106 at the expanded depth.

Figure 7C:
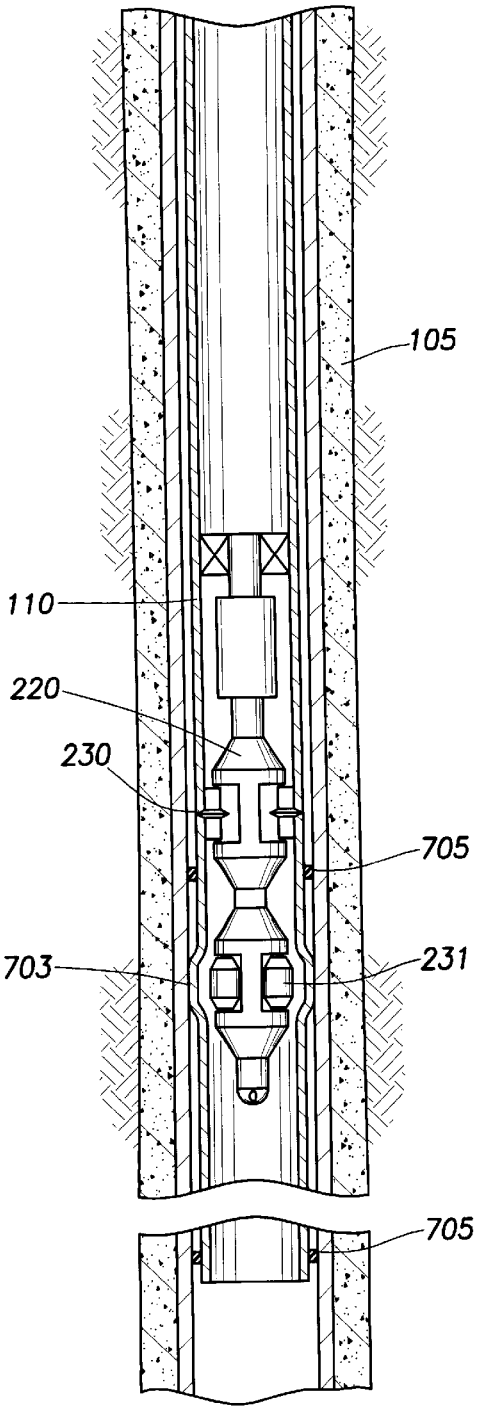
FIG. 7C is a sectional view of the wellbore of FIG. 7B. The coiled tubing has been expanded along a desired length into frictional engagement with the surrounding casing. The cutting tool is now being actuated so as to sever the coiled tubing in situ.

FIG. 7C is a sectional view of the wellbore of FIG. 7B. In this view, the cutting tool 220 is now being actuated so as to sever the coiled tubing 110 in situ. In this respect, the expandable members 228 of the cutting tool 220 have been expanded by the application of additional hydraulic pressure through the coiled tubing 110. Actuation of the expandable members 228 causes the cutting instrument 229 to contact the inner surface of the coiled tubing 110. Rotation of the cutting tool 220 by the motor 210 creates a radial cut in the coiled tubing 110, thereby severing the coiled tubing string 110 from the portion of coiled tubing 703 being expanded, thereby forming a severed upper string of coiled tubing 110 and an expanded lower patch 703.

It is noted that the ports 225 of the cutting tool 220 in the arrangement of FIG. 7C are configured to require greater hydraulic pressure to actuate than is necessary for actuation of the expander tool 230. In this respect, a first pressure may be injected into the coiled tubing 110 in order to actuate the expander tool 230. The coiled tubing 110 may optionally be raised and lowered by translating the coiled tubing string 110 from the surface in order to increase the length of the patch 703. Once the desired expansion has been accomplished, an increased pressure. can be applied through the coiled tubing 110 downhole. The increased pressure will then actuate the cutting tool 220.

Figure 7D:
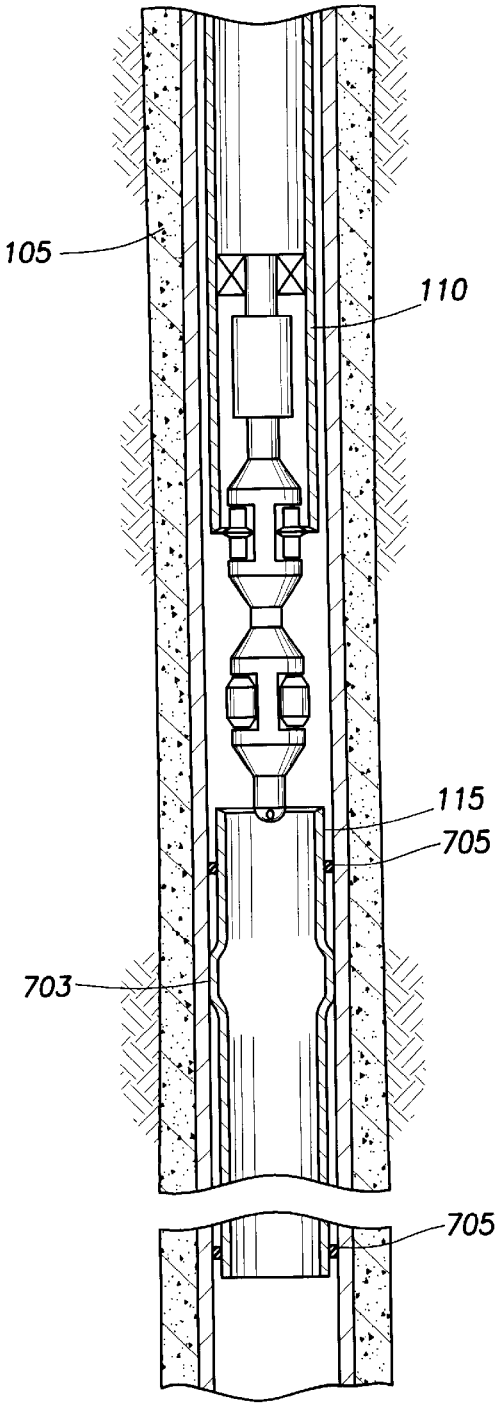
FIG. 7D is a sectional view of the wellbore of FIG. 7C. In this view, the severed upper portion of coiled tubing is being removed from the wellbore, along with the expansion assembly.

Once the coiled tubing 110 has been severed and the patch 703 has been formed, the pressure in the expansion assembly 700 is reduced to disengage both the expandable members 228 of the cutting tool 220 and the rollers 231 of the expander tool 230. The expansion assembly 700 is then retrieved from the wellbore 105, as shown in FIG. 7D. Because the expansion assembly 700 remains connected to the coiled tubing 110 by means of the slips 205, removal of the coiled tubing 110 removes the expansion assembly 700. An expanded patch 703 is thus left within the wellbore 105.

In the arrangement of FIGS. 7A–7D, the expandable section of coiled tubing 115 includes an optional sealing member 705 disposed circumferentially around the outer wall of the coiled tubing 115. Preferably, the sealing member 705 defines two separate sealing rings positioned at the upper and lower ends of the severed section 115. The sealing member 705 is incorporated onto the coiled tubing 110 at the surface before expansion operations begin. In this way, the patch 703 provides a more secure fluid seal against the surrounding casing 106.

The seal rings 705 are fabricated from a suitable material based upon the service environment that exists within the wellbore 105. Factors to be considered when selecting a suitable sealing member 705 include the chemicals likely to contact the sealing member, the prolonged impact of hydrocarbon contact on the sealing member, the presence and concentration of erosive compounds such as hydrogen sulfide or chlorine and the pressure and temperature at which the sealing member must operate. In a preferred embodiment, the sealing member 705 is fabricated from an elastomeric material. However, non-elastomeric materials or polymers may be employed as well, so long as they substantially prevent production fluids from passing from the formation and into the wellbore 105 at the point of the patch 703.

The expandable section of coiled tubing 115 may also optionally include a hardened gripping surface (not shown) such as a carbide button. Upon expansion of the coiled tubing 115, the gripping surface would bite into the surrounding casing 106, thereby further providing frictional engagement therebetween.

Figure 8A:
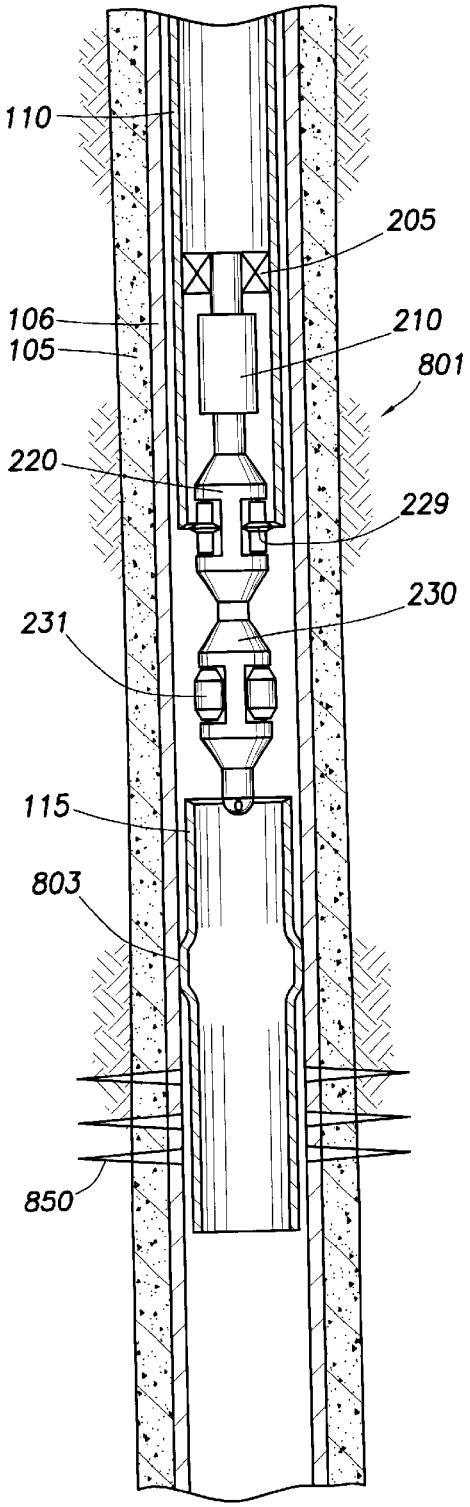
FIG. 8A is a sectional view of the wellbore of FIG. 7D. In this view, a second assembly for expanding coiled tubing is being run into the wellbore. The second expansion assembly does not have the cutting tool.

An alternate method of the present invention provides for the installation of a patch of coiled tubing through two-trips. Referring to FIG. 8A, a first expansion assembly 800 is run into the wellbore 105. This first expansion assembly 801 comprises a slip 205, a rotary motor 210, a cutting tool 220 and an expander tool 225. Thus, expansion assembly 801 is comparable to expansion assembly 600 used in the one trip method shown in FIG. 7A–7D. Expansion assembly 801 is run into the wellbore on the coiled tubing 110. The expansion assembly 801 and attached coiled tubing 110 are positioned at the wellbore depth at which a patch 803 is to be installed. The patch 803 is then installed according to the method outlined above in connection with FIGS. 7A–7D.

FIG. 8A shows a severed portion 115 of coiled tubing 110 left in the wellbore 105. A portion of the severed tubing 115 has been expanded in order to serve as a patch 803. The first expansion assembly 801 is being retrieved by pulling the coiled tubing 110 from the hole 105. This represents the first trip.

Figure 8B:
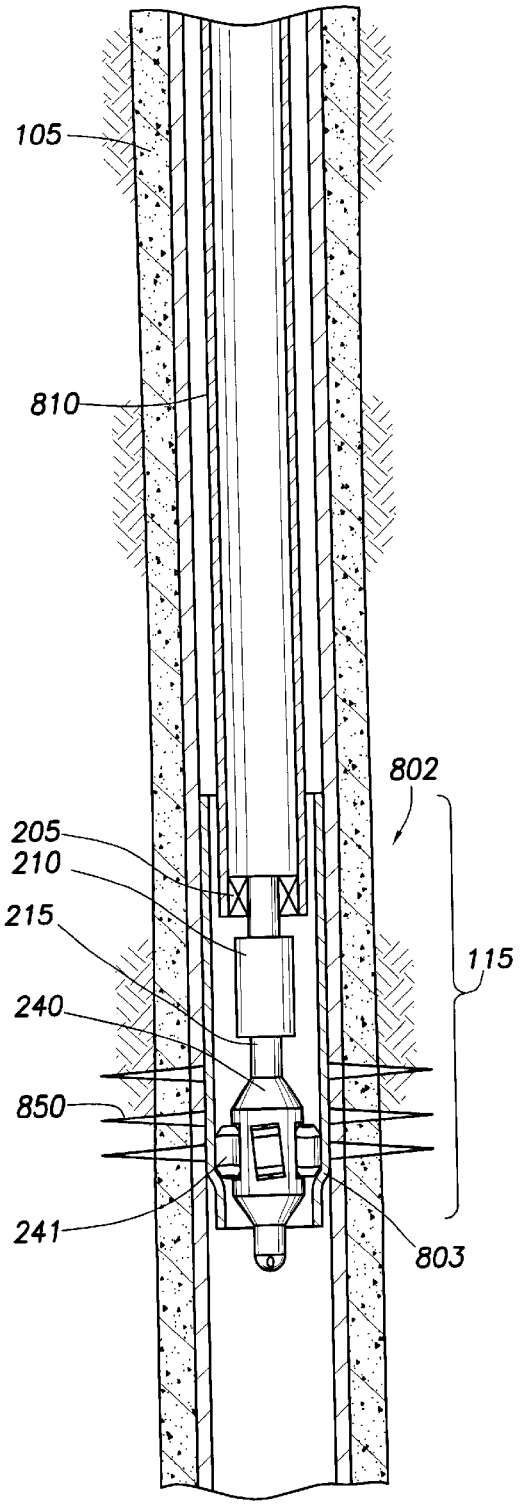
FIG. 8B is a sectional view of the wellbore of FIG. 8A. In this view, the second expansion assembly has been run into the wellbore. The expander tool is seen expanding the entire length of patch into the surrounding casing.

FIG. 8B presents the second trip of the alternate method of the present invention. As shown in FIG. 8B, a second expansion assembly 802 is run into the wellbore 105. The second expansion assembly 802 comprises a slip 205, a rotary motor 210, and a rolling tool 240. The rolling tool 240 is, in actuality, a second expander tool. The second expansion assembly 802 is run into the wellbore 105 on a working string 810 such as coiled tubing. The rolling tool 240 is similar to the expander tool 230 described in FIGS. 4 and 5, except that rollers 241 of the rolling tool 240 are pitched relative to a center line of the body 232. Because rollers 241 are angled, the rolling tool 240 is able to "walk" downward along an inner surface of the severed coiled tubing 115. In this respect, rotation of the rolling tool 240 by the downhole motor 210 causes the rolling tool 240 to self-progress axially from top to bottom, thereby forming a patch 803 which extends the length of the severed tubing 115.

In order to aid the translation of the expander tool 241 in FIG. 8B, an extendable joint, or telescoping member 215 is provided. The telescoping member 215 is positioned below the rotary motor 210. The telescoping member 215 allows the radially expanding tool 240 to move axially within the wellbore 105 without having to manipulate the depth of the coiled tubing 1010 from the surface.

In FIGS. 8A and 8B it can be seen that the severed portion of coiled tubing 115 has been positioned over perforations 850. In FIG. 8A, the severed portion of coiled tubing 115 has been partially expanded so that the severed portion 115 is in frictional engagement with the inner surface of the casing 106. In this manner, the severed portion is hung in the wellbore 105 by use of the first expansion assembly 801. Then, in FIG. 8B, the second expansion assembly 802 is used to more fully expand the severed portion of coiled tubing 115 into frictional engagement with the casing 106. Thus, a two-trip method for installing a coiled tubing- patch 803 is provided.

In yet another aspect of the present invention, an expansion assembly 900 is provided for expanding coiled tubing into surrounding casing. Referring to FIGS. 9A–9D, coiled tubing 110 is run into the wellbore in two sections. The two sections represent an upper section 910 and a lower section 915. The upper 910 and lower 915 sections of coiled tubing are formed by severing the coiled tubing string at the surface before the tubing is run into the wellbore 105. Thus, downhole cutting tool 210 is not needed for expansion assembly 900 as the coiled tubing 910 is pre-cut.

Figure 9A:
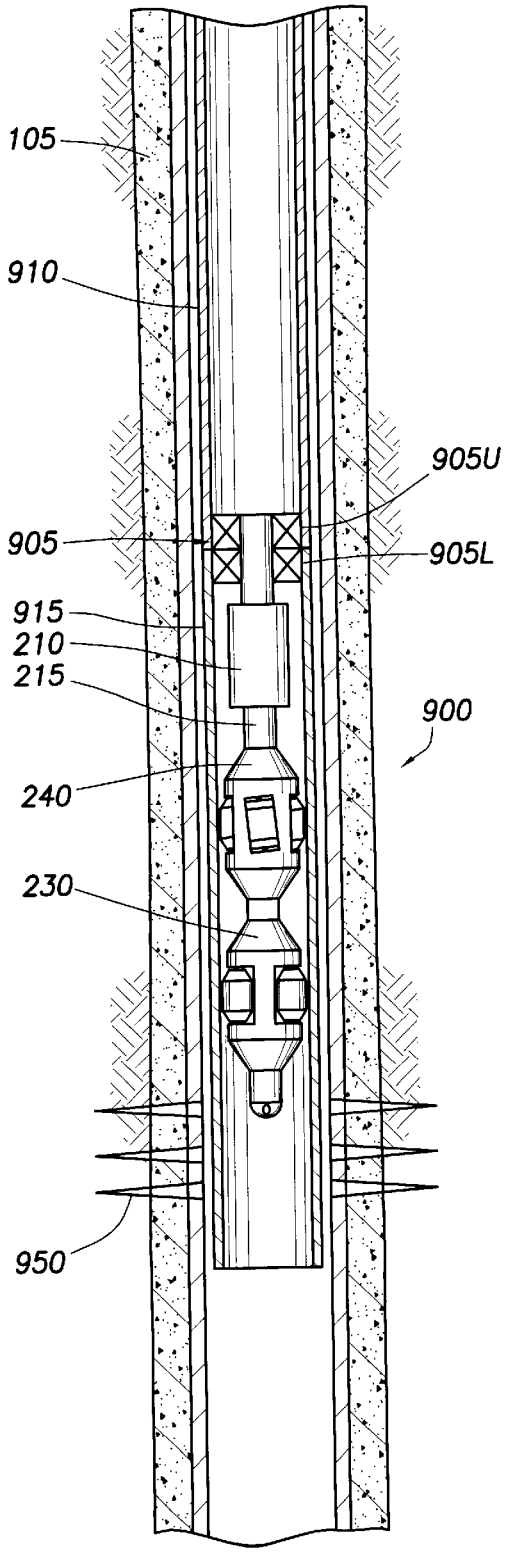
FIG. 9A is a sectional view of a wellbore having an alternate embodiment of an expansion assembly of the present invention. The expansion assembly is being run into the wellbore on a string of severed coiled tubing. Separate slip members are shown for supporting upper and lower sections of coiled tubing. In addition, two separate expander tools are shown.

FIG. 9A depicts an expansion assembly 900 for an alternate one-trip patching method. The components for expansion assembly 900 comprise an upper slip 905U, a lower slip 905L, a rotary motor 210, a pitched rolling tool 240 and an expander tool 230. The rotary motor 210, the pitched rolling tool 240 and the expander tool 230 are as described for the one and two-trip methods disclosed above. However, expansion assembly 900 differs in that it employs a dual slip system. The upper slip 905U engages the upper section of coiled tubing 910, while the lower slip 905L engages the lower section of coiled tubing 915. The lower section of coiled tubing 915 will be expanded to serve as the patch 903 for this alternate method.

As shown in FIG. 9A, the upper 910 and lower 915 sections of coiled tubing are retained adjacent to each other with a point of contact therebetween. At the surface, the coiled tubing 910 is partially introduced into the wellbore 105, and then severed. This creates the upper section 910 above the surface and the lower section 915 at least partially disposed within the wellbore 105. Slip 905U is actuated to engage the upper section 910 of coiled tubing, and slip 905L is actuated to engage the lower section 915 of coiled tubing. Slips 905U and 905L may be separate slips, or are preferably a single slip have slip members that are de-activated independently.

When the slips 905U and 905L are actuated, the expansion assembly 900 is run into and located within the wellbore 105 adjacent one or more perforations 950 to be isolated as illustrated in FIG. 9A. It is understood, however, that the patching operation may be employed to simply patch a corroded section of tubular without perforations.

Figure 9B:
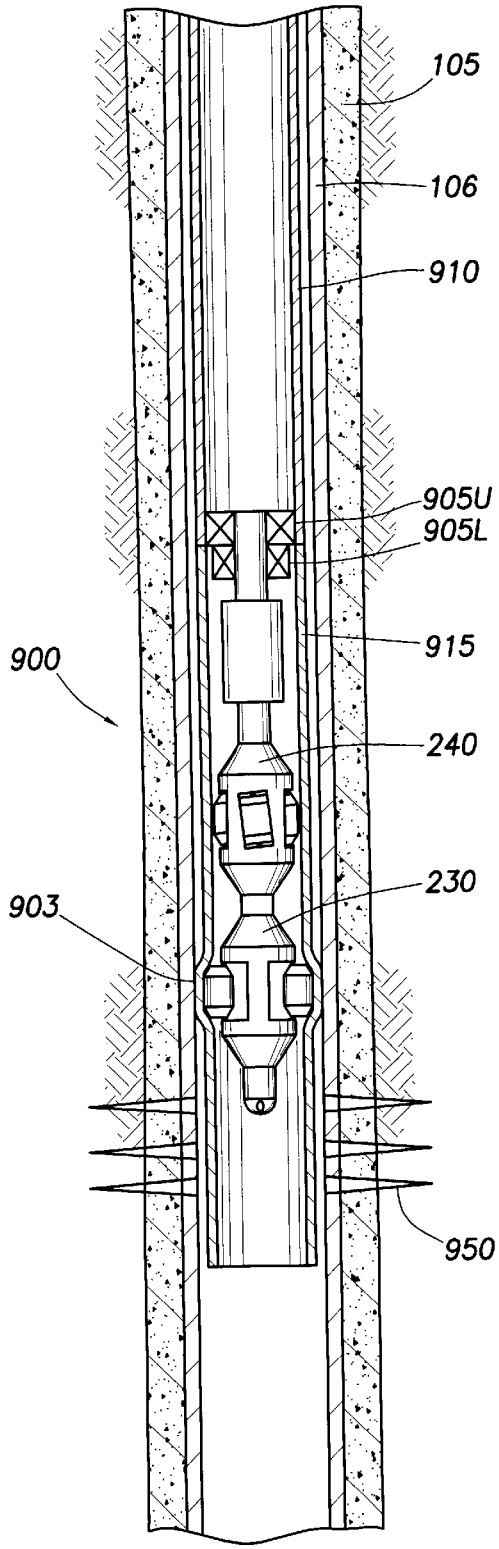
FIG. 9B is a cross-sectional view of the wellbore of FIG. 9A. The lower expander tool has been actuated so as to begin expanding the section of coiled tubing into the surrounding casing.

FIG. 9B is a section view showing a portion of the coiled tubing 915 expanded by the expander tool 230. The expander tool 230 is actuated to form an annular extension 903 of the coiled tubing 915. Once the lower section 915 of coiled tubing has been expanded, thus anchoring the lower section 915 to the casing 106, the lower slip 905L is de-activated. This releases the lower section 915 of coiled tubing from the expansion assembly 900.

The next set in this alternate patching method is the raising of the expansion assembly 900. In this respect, the upper section 910 of coiled tubing is lifted so as to align the rolling tool 240 with the upper end of the lower section of coiled tubing 915. Once this alignment is made, the rolling tool 240 is activated. As discussed above, rotation of the pitched rolling tool 240 causes the tool 240 to "walk" downward along an inner surface of the severed coiled tubing 915. In this respect, rotation of the rolling tool 240 by the rotary motor 210 causes the rolling tool 240 to self-progress axially from top to bottom, thereby forming a patch 903 which extends the length of the severed tubing 915.

Figure 9C:
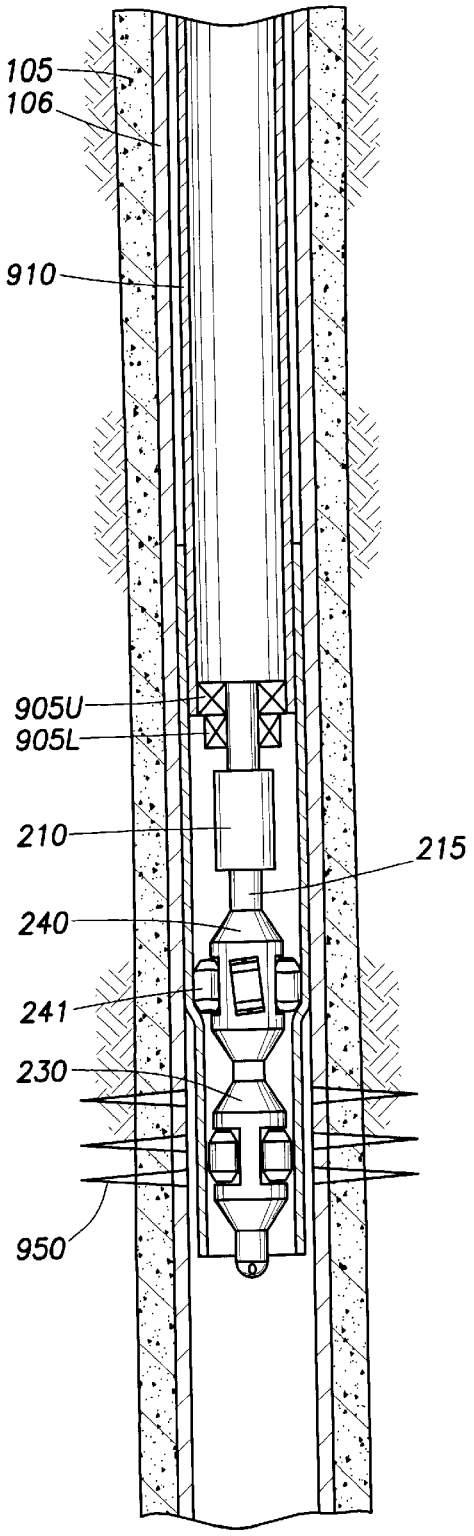
FIG. 9C is a section view of the wellbore of FIG. 9B. In this view, the lower expander tool has been deactivated. The upper expander tool has been actuated in its place and is "walking" down through the lower section of coiled tubing in order to form a patch.

FIG. 9C is a section view showing the coiled tubing 915 being expanded along its length by the rolling tool 240. The upper slip 905U is still engaged to the upper section 910 of coiled tubing. The rolling tool 240 is activated and allowed to "walk" and expand the inner surface of the lower section 915 of tubing. As the rolling tool 240 expands the inner diameter of the lower section 915 of tubing, the expansion assembly 900 and upper section 910 of coiled tubing pass through the expanded diameter of the lower section 915 of tubing.

Figure 9D:
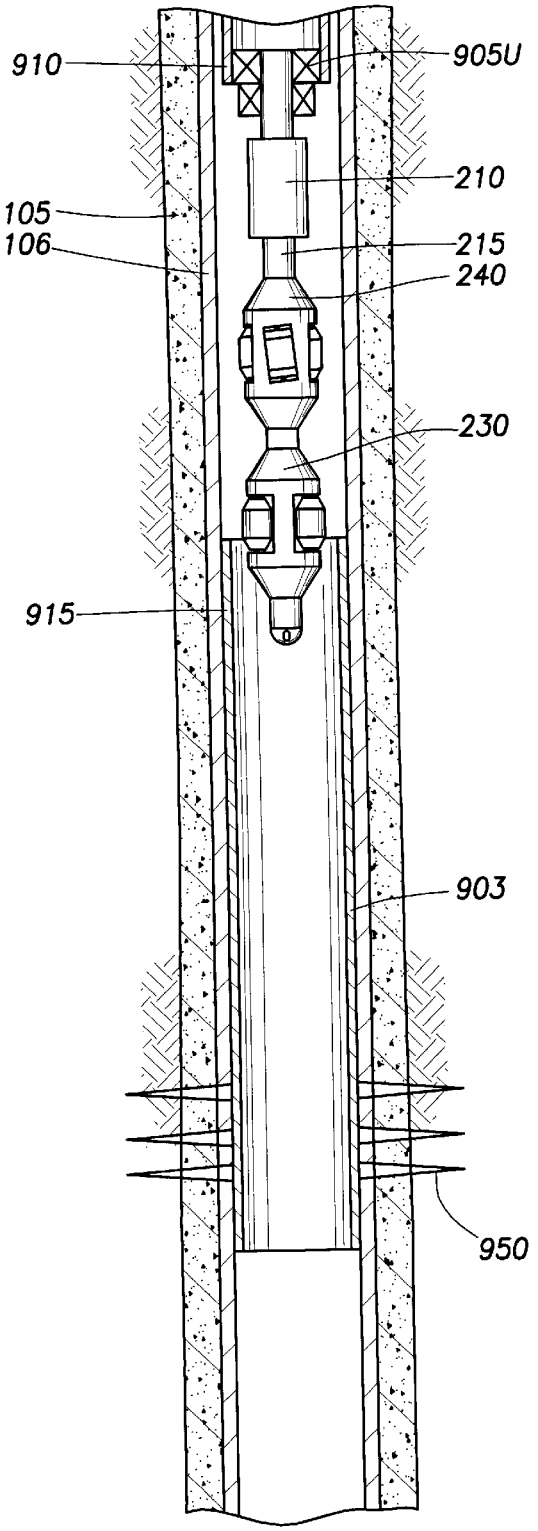
FIG. 9D presents a cross-sectional view of the wellbore of FIG. 9C. Here, the coiled tubing has been completely expanded into the surrounding casing. The upper section of coiled tubing is being pulled from the wellbore, leaving a patch in place wellbore. The alternate expansion assembly is now being removed from the wellbore.

FIG. 9D shows the lower section of coiled tubing 915 completely expanded into the casing 106. At this stage, the coiled tubing patch 903 is fully installed. In this respect, the patch 903 is now synonymous with the lower section of tubing 915. The severed upper portion of coiled tubing 910 is being removed from the wellbore.

Figure 10A:
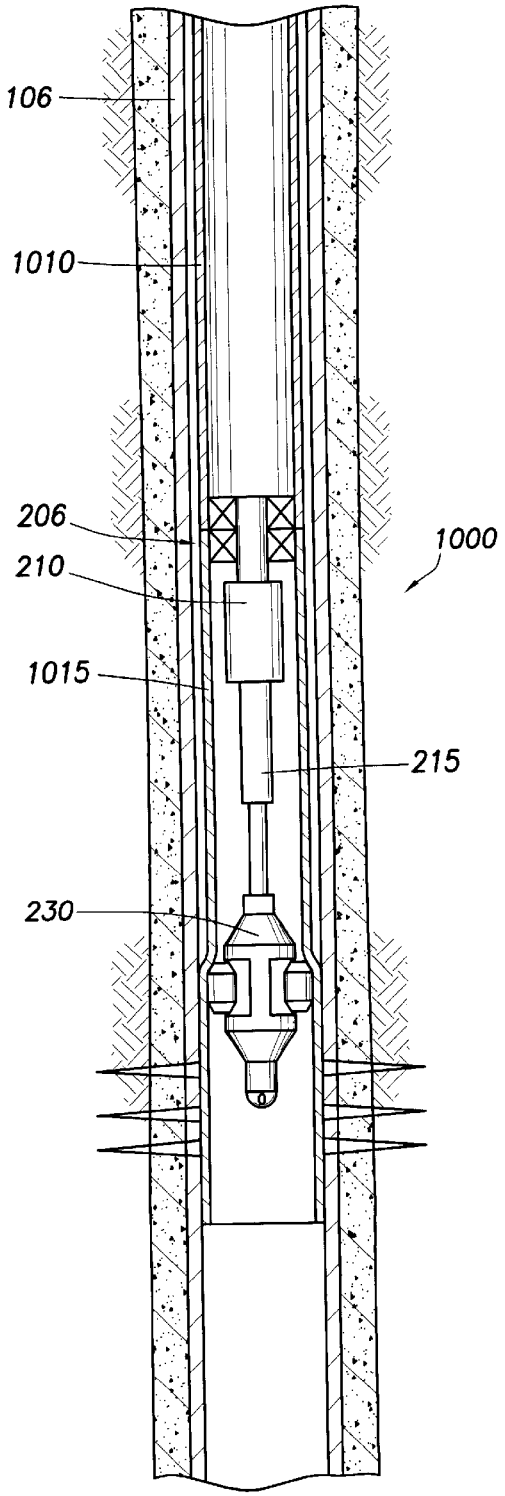
FIG. 10A is a sectional view of a wellbore having still another alternate expansion assembly of the present invention. This arrangement of an expansion assembly utilizes a telescoping member. In one arrangement, the telescoping extension member translates the expander tool through the lower section of the coiled tubing.

In yet another aspect of the present invention, a one-trip method for installing a coiled tubing patch is provided which utilizes an extendable or telescoping member to vertically translate the roller tool 240. The telescoping member 215 is depicted in FIG. 10A, and is positioned below the rotary motor 210. The telescoping member 215 allows the radially expanding tool 230 to move axially within the wellbore 105 without having to manipulate the depth of the coiled tubing 1010 from the surface.

It is noted that the telescoping member 215 can be employed in any of the methods which fall within the scope of the present invention. In this respect, the makeup joint shown as 215 in the various figures herein may constitute a telescoping member. The telescoping member 215 may be electrically operated so as to mechanically move the expanding tools 230 and 240. Alternatively, the telescoping member 215 may be actuated through hydraulic pressure applied through the coiled tubing 1010 from the surface. Alternatively, the telescoping member 215 may be fixed in a recessed position by a shearable screw (not shown) or other releasable connection, until the roller tool 240 is actuated. In this arrangement, actuation of the roller tool 240 (shown in FIGS. 9A–9D) would cause the releasable connection to release, thereby allowing the telescoping member 215 to extend while the roller tool 240 "walks" itself. The roller tool 240 preferably has rollers 241 which are pitched to walk downward upon rotation. However, the pitch of the rollers 241 may be oriented to cause the roller tool 240 to walk upward.

It is also noted that the use of an electrically or hydraulically actuated telescoping member 215 will remove the necessity for the roller tool 240. In this regard, the telescoping member 215 would itself translate the expander tool 230, causing the coiled tubing 1015 to be expanded along a desired length. In FIG. 10A, the pitched roller tool is removed. Thus, the expansion assembly 1000 does not employ either a downhole cutting instrument or a pitched roller tool.

Figure 10B:
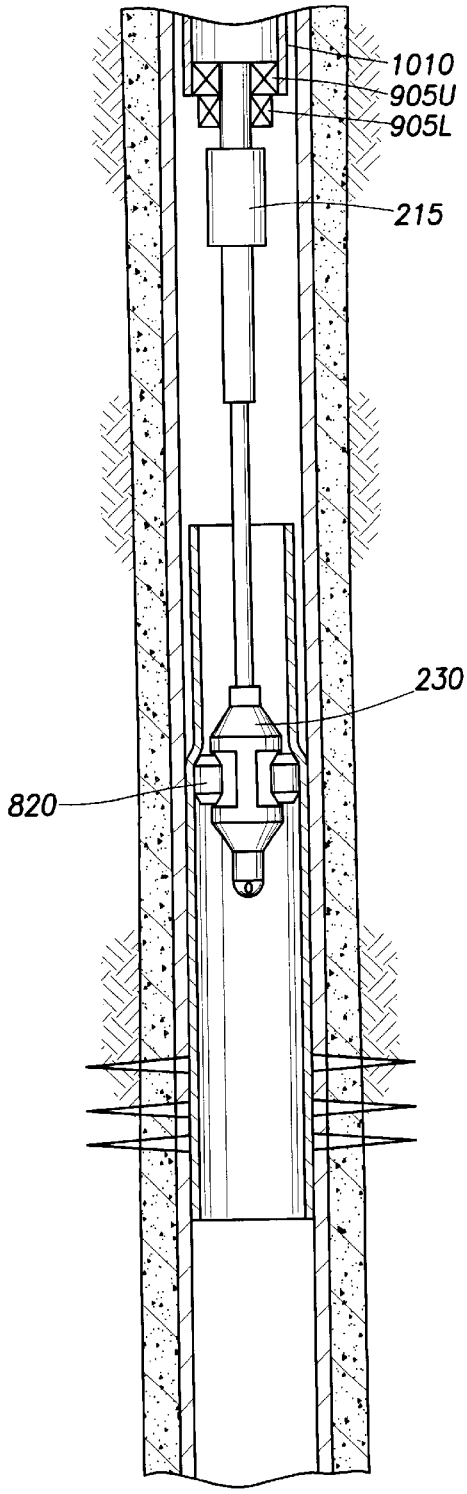
FIG. 10B is a sectional view of the wellbore of FIG. 10A. In this view, the lower section of coiled tubing is being further expanded into surrounding casing.

FIG. 10A and FIG. 10B demonstrate the operation of the telescoping member 215. In FIG. 10A, the telescoping member 215 is extended so that the expander tool 230 is translated downward to the bottom end of the lower section of tubing 1015. In FIG. 10B, the telescoping member 215 is being retracted so as to raise the expander tool 230. The upper section of tubing 1010 is also being optionally raised to further raise the expander tool 230 within the lower section of tubing 1015. It is noted that a more uniform expansion and patch job is obtained by translating the expander tool 230 from downhole, rather than by trying to pull the coiled tubing 1010 from the surface. In this respect, downhole translation avoids problems associated with pipe stretch and recoil which interfere with a smooth and uniform patch.

Once the coiled tubing 1015 has been satisfactorily expanded to form a patch, the upper section of coiled tubing 1010 is retrieved from the hole 105. The expansion assembly 1000 is thereby removed from the hole 105 due to the connection with slip 905U.

Figure 11C:
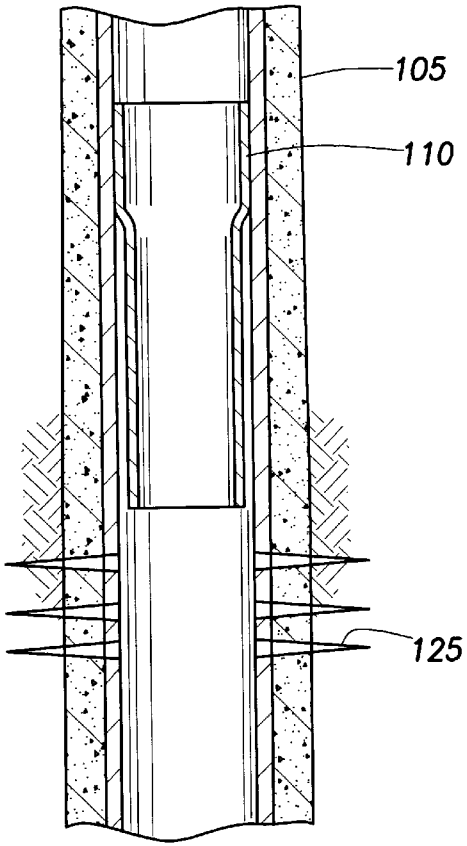
FIG. 11C is a cross-section view of a wellbore having a section of coiled tubing expanded therein. In this view, the coiled tubing has been expanded at a point above a perforated portion of casing in order to form a velocity tube.

The wellbore arrangements shown in FIGS. 8B and 9D present a section of coiled tubing completely expanded into a surrounding string of casing along a desired length. In this way, a coiled tubing patch is formed. Such a coiled tubing patch may be used not only to support casing or sand screen, but also to seal perforations. FIG. 11A is a cross-sectional view of a wellbore 105 having a section of coiled tubing 115 expanded therein. In this view, the section of coiled tubing has been completely expanded along a desired length in order to seal off perforations 125 within the casing 106 and surrounding formation 107.

Figure 11B:
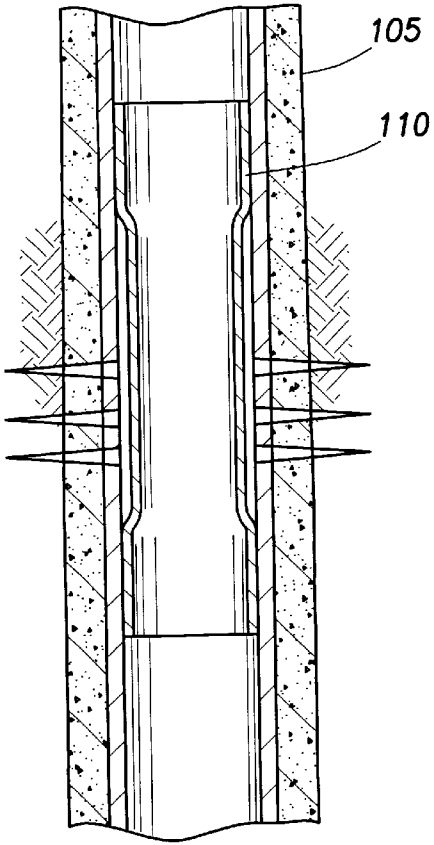
FIG. 11B is a cross-sectional view of a wellbore having a section of coiled tubing expanded therein. In this view, the coiled tubing has been expanded at points above and below a perforated portion of casing in order to form a straddle.
Figure 11A:
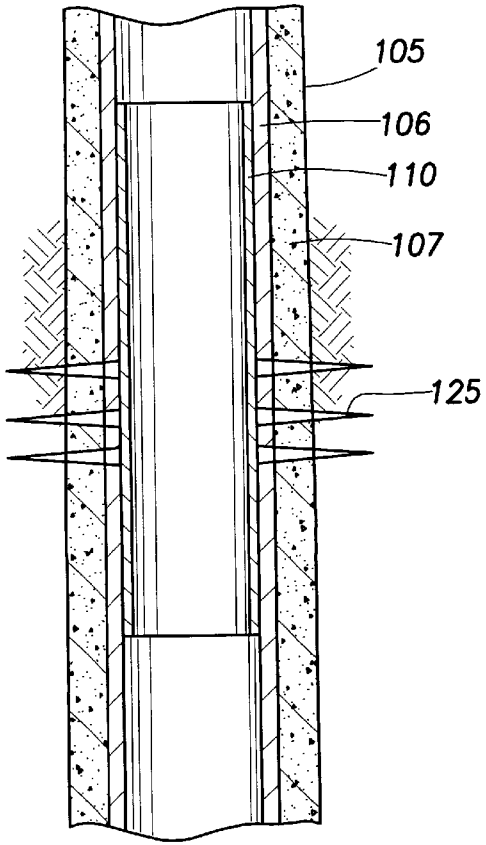
FIG. 11A is a cross-sectional view of a wellbore having a section of coiled tubing expanded therein. In this view, a section of coiled tubing has been completely expanded along a desired length in order to seal off a perforated portion of casing.

FIG. 11B presents an alternate method for installing a patch. FIG. 11B shows a cross-sectional view of a wellbore 105 having a section of coiled tubing 115 expanded therein. In this view, the coiled tubing 115 has been expanded at points above and below perforations 125 within the casing 106 and surrounding formation 107 in order to form a straddle.

FIG. 11C presents yet an alternate method for installing a patch. FIG. 11C shows a cross-section view of a wellbore 105 having a section of coiled tubing 115 expanded therein. In this view, the coiled tubing 115 has been expanded at a point above a perforated portion of casing 106 and surrounding formation 107 in order to form a velocity tube.

While the foregoing is directed to the preferred embodiment of the present invention, other and further embodiments of the invention may be devised without departing from the basic scope thereof, and the scope thereof is determined by the claims that follow.

What is claimed is:

1. A method of installing an expandable coiled tubing portion into a surrounding tubular body within a wellbore, the method comprising the steps of:

running a string of coiled tubing into the wellbore to a desired depth adjacent a tubular body, the coiled tubing having an inner surface and an outer surface, and the surrounding tubular body having an inner surface and an outer surface;

expanding the string of coiled tubing at a first depth so as to engage the outer surface of a first portion of the coiled tubing with the inner surface of the surrounding tubular body at the first depth;

disconnecting the string of coiled tubing from the expanded first portion of coiled tubing, thereby forming a disconnected string of coiled tubing and a first expanded coiled tubing portion; and removing the disconnected string of coiled tubing from the wellbore.

2. The method of claim 1, wherein the surrounding tubular body is a sand screen.

3. The method of claim 1, wherein the surrounding tubular body is a string of casing.

4. The method of claim 1, wherein the expanded first portion of coiled tubing engages the surrounding tubular body at a depth of perforations, so as to seal the perforations.

5. The method of claim 1, further comprising the step of:

expanding the string of coiled tubing at a second depth so as to engage the outer surface of a second portion of the coiled tubing with the inner surface of the surrounding tubular body at the second depth.

6. The method of claim 5, wherein the first expanded coiled tubing portion engages the surrounding tubular body at a first depth above perforations, and the second expanded coiled tubing portion engages the surrounding tubular body at a second depth below perforations, so as to straddle the perforations.

7. The method of claim 1, wherein the expanded first portion of coiled tubing portion engages the surrounding tubular body at a depth above perforations.

8. The method of claim 7, wherein the expanded coiled tubing portion supports a velocity tube.

9. A method for expanding a first tubular into a second surrounding tubular within a wellbore, comprising the steps of:

assembling a first expansion assembly within the first tubular, the expansion assembly comprising a slip, a motor, a cutting tool, and an expander tool;

running the first expansion assembly into the wellbore with the first tubular;

positioning the first expansion assembly within the wellbore adjacent a selected section of the second tubular;

actuating the expander tool to at least expand the first tubular into frictional engagement with the second surrounding tubular along a desired length; and actuating the cutting tool so as to cut the first tubular above the point at which the first tubular has been expanded, thereby forming a severed upper first tubular and a lower patch within the wellbore.

10. The method of claim 9, wherein the first tubular is a string of coiled tubing.

11. The method of claim 10, wherein the surrounding second tubular is a string of production tubing.

12. The method of claim 10, wherein the surrounding second tubular is a sand screen.

13. The method of claim 10, wherein the second surrounding tubular is string of casing.

14. The method of claim 13, wherein the patch has a first elastomeric seal ring circumferentially disposed around the outer surface of the coiled tubing below the point of expansion, and a second elastomeric seal ring circumferentially disposed around the outer surface of the coiled tubing above the point of expansion.

15. The method of claim 14, wherein the wellbore is a live wellbore.

16. The method of claim 13, wherein the slip is positioned at the upper end of the first expansion assembly, and is expanded to engage the inner surface of the coiled tubing when the first expansion assembly is run into the wellbore;

the motor is a rotary motor, and is positioned below the slip; and the expander tool is a rotary expander tool.

17. The method of claim 16, wherein the coiled tubing patch engages the surrounding string of casing at a depth of perforations, so as to seal the perforations.

18. The method of claim 16, wherein the coiled tubing patch engages the surrounding string of casing at a depth above and below perforations, so as to straddle the perforations.

19. The method of claim 16, wherein the coiled tubing patch engages the surrounding string of casing at a depth above perforations, so as to support a velocity tube.

20. The method of claim 16, wherein the expander tool is rotated by the motor, and wherein the expander tool comprises an elongated hollow inner body and a plurality of rollers which expand outwardly from the body upon the application of a first amount of hydraulic pressure so as to expand the coiled tubing into frictional engagement with the inner surface of the casing.

21. The method of claim 20, wherein the cutting tool has an elongated hollow inner body, and a plurality of expandable members which expand outwardly from the body upon the application of a second amount of hydraulic pressure which is greater than the first amount of hydraulic pressure, the expandable members having a cutting instrument, and the cutting tool being rotated by the motor.

22. The method of claim 16, further comprising the step of translating the actuated expander tool axially within the wellbore so as to expand the coiled tubing along a desired length, thereby extending the length of the patch.

23. The method of claim 22, wherein the step of translating the actuated expander tool is accomplished by raising the coiled tubing from the surface while the expander tool is actuated.

24. The method of claim 16, wherein the first expansion assembly further comprises a telescoping member below the slip; and the step of translating the actuated expander tool is accomplished by extending the telescoping member while the expander tool is actuated.

25. The method of claim 10, further comprising the step of retrieving the expansion assembly from the wellbore by pulling the severed portion of coiled tubing above the point of severance.

26. The method of claim 25, further comprising the steps of:

running a second expansion assembly into the wellbore on a working string, the second expansion assembly being positioned at the lower end of the working string, the second expansion assembly comprising a slip, a rotary motor, and an expander tool;

positioning the expander tool of the second expansion assembly adjacent the patch;

actuating the expander tool of the second expansion assembly; and translating the expander tool of the second expansion assembly across the entire length of the patch so as to substantially expand the entire length of the patch into frictional engagement with the second surrounding tubular.

27. The method of claim 26, wherein the second surrounding tubular is a string of casing.

28. The method of claim 27, wherein the slip of the first expansion assembly is positioned at the upper end of the first expansion assembly, and is expanded to engage the inner surface of the coiled tubing when the first expansion assembly is run into the wellbore;

the motor of the first expansion assembly is a rotary motor, and is positioned below the slip of the first expansion assembly;

the expander tool of the first expansion assembly is a rotary expander tool, the expander tool of the first expansion assembly having an elongated hollow inner body, and a plurality of rollers which expand outwardly from the body upon the application of a first amount of hydraulic pressure so as to expand the coiled tubing into frictional engagement with the inner surface of the casing; and the cutting tool has an elongated hollow inner body, and a plurality of expandable members which expand outwardly from the body upon the application of a second amount of hydraulic pressure which is greater than the first amount of hydraulic pressure, the expandable members having a cutting instrument, and the cutting tool being rotated by the motor.

29. The method of claim 26, wherein:

the expander tool of the second expansion assembly is a rotary expander tool which is rotated by the motor of the second expansion assembly, the expander tool of the second expansion assembly comprising:

an elongated hollow inner body, a plurality of rollers which expand outwardly from the body upon the application of hydraulic pressure so as to expand the coiled tubing into frictional engagement with the inner surface of the surrounding casing; and the plurality of rollers are configured at a pitch such that rotation of the expander tool of the second expansion assembly causes the expander tool to progress axially within the wellbore; and the step of translating the expander tool of the second expansion assembly is accomplished by rotating the expander tool of the second expansion assembly.

30. A method for expanding a section of coiled tubing into a surrounding string of casing within a wellbore, comprising the steps of:

assembling an expansion assembly within a string of coiled tubing, the expansion assembly comprising a first slip, a second slip, a motor, and a first expander tool;

actuating the first slip within the coiled tubing;

actuating the second slip within the coiled tubing;

disconnecting the coiled tubing so as to form an upper section and a lower section, the upper section being engaged by the first slip, and the lower section being engaged by the second slip;

running the expansion assembly into the wellbore with the upper and lower sections of coiled tubing;

positioning the expansion assembly within the wellbore adjacent a selected section of the casing;

actuating the first expander tool to at least partially expand the lower section of coiled tubing into frictional engagement with the surrounding casing, thereby forming a patch within the wellbore.

31. The method of claim 30, further comprising the steps of:

de-activating the second slip after the lower section of coiled tubing has been initially expanded;

translating the first expander tool along a desired length of the lower string of coiled tubing, thereby extending the length of the patch.

32. The method of claim 31, wherein the expansion assembly further comprises a telescoping member below the slip; and the step of translating the actuated expander tool is accomplished by extending the telescoping member while the expander tool is actuated.

33. The method of claim 31, wherein the step of translating the actuated expander tool is accomplished by raising the coiled tubing from the surface while the expander tool is actuated.

34. The method of claim 30, wherein the expansion assembly further comprises a second expander tool having:

an elongated hollow inner body, a plurality of rollers which expand outwardly from the body upon the application of hydraulic pressure so as to expand the coiled tubing into frictional engagement with the inner surface of the surrounding casing; and the plurality of rollers are configured at a pitch such that rotation of the second expander tool causes the second expander tool to progress axially within the wellbore.

35. The method of claim 30, further comprising the steps of:

de-activating the second slip after the lower section of coiled tubing has been initially expanded; and translating the second expander tool along a desired length of the lower string of coiled tubing by rotating the second expander tool of the second expansion assembly, thereby extending the length of the patch.

36. The method of claim 35, further comprising lowering the expansion assembly as the second expander tool advances axially within the wellbore.

37. The method of claim 36, wherein the expansion assembly further comprises a telescoping member below the slip; and the step of translating the actuated expander tool is further accomplished by extending the telescoping member while the expander tool is actuated.

38. The method of claim 36, wherein the step of translating the actuated expander tool is further accomplished by raising the coiled tubing from the surface while the expander tool is actuated.

* * * * *